United States Patent [19]

Demler, Jr. et al.

[11] Patent Number: 4,869,676

[45] Date of Patent: Sep. 26, 1989

[54] CONNECTOR ASSEMBLY FOR USE BETWEEN MOTHER AND DAUGHTER CIRCUIT BOARDS

[75] Inventors: Henry W. Demler, Jr., Lebanon, Pa.; Frank P. Dola, Hudson, Fla.; David J. Kimmel, Clearwater, Fla.; Thomas J. Sotolongo, Clearwater Beach, Fla.

[73] Assignee: AMP Incorporated, Harrisburg, Pa.

[21] Appl. No.: 219,949

[22] Filed: Jul. 15, 1988

Related U.S. Application Data

[63] Continuation-in-part of Ser. No. 96,792, Sep. 11, 1981, which is a continuation of Ser. No. 866,518, May 23, 1986, abandoned.

[51] Int. Cl.[4] ..... H01R 13/658

[52] U.S. Cl. ..... 439/79; 439/101; 439/608

[58] Field of Search ..... 439/59-62, 439/79, 80, 92, 101, 108, 607, 608, 609, 610; 361/407

[56] References Cited

U.S. PATENT DOCUMENTS

| | | | |
|---|---|---|---|
| 3,470,421 | 9/1969 | Shore et al. | 317/101 |
| 3,533,044 | 10/1970 | Bauman et al. | 339/14 |
| 4,475,781 | 10/1984 | Asick | 339/17 LM |
| 4,616,893 | 10/1986 | Feldman | 339/14 R |
| 4,632,476 | 12/1986 | Schell | 339/14 R |
| 4,655,518 | 4/1987 | Johnson | 339/17 LC |
| 4,755,145 | 7/1988 | Johnson et al. | 439/61 |
| 4,762,500 | 8/1988 | Dola | 439/79 |

OTHER PUBLICATIONS

IBM Technical Disclosure Bulletin, vol. 10, No. 3, dated Aug. 1967.

*Primary Examiner*—Neil Abrams
*Attorney, Agent, or Firm*—Robert W. Pitts

[57] ABSTRACT

A backplane connector assembly including signal interconnection, ground interconnection, and power interconnection means in both a motherboard connector and a daughterboard connector is disclosed. The motherboard connector consists of a single connector having signal terminals, ground terminals, and power terminals. The daughterboard connector assembly consists of a daughterboard signal housing having signal and ground terminals and a separate daughterboard power housing positioned on the opposite surface of the daughterboard from the daughterboard signal connector subassembly. Power terminals in both the motherboard connector and the daughterboard connector are oriented perpendicular to the daughterboard so that daughterboards having varying thicknesses can be employed. This invention can be used in a connector having a cast metallic outer shield or in a connector having a conventional insulative outer housing.

17 Claims, 17 Drawing Sheets

132'
128
125
100
132
32'
34'
36'
24
22
40
32
34
36
20
26
70
60
92
30
42
44
46
48
52
50
13

CONNECTOR ASSEMBLY FOR USE BETWEEN MOTHER AND DAUGHTER CIRCUIT BOARDS

CROSS-REFERENCE TO PENDING APPLICATION

This application is a continuation-in-part of co-pending U.S. patent application Ser. No. 096,792 filed Sept. 11, 1987 which is a continuation of U.S. patent application Ser. No. 866,518 filed May 23, 1986, now abandoned.

BACKGROUND OF THE INVENTION

Field of the Invention

This invention relates to a backplane connector assembly consisting of a printed circuit board connector which is matable with connectors mounted to a daughterboard extending at right angles to the motherboard and provides for distribution of both power and signal from the motherboard to the daughterboard.

Description of the Prior Art

Backplane systems consisting of a backplane or motherboard to which a plurality of orthogonally oriented daughterboards conventionally employ a plurality of connectors to distribute both current and power from the single motherboard or backplane to the plurality of daughterboards. Both the motherboard and the daughterboards generally require a large number of conductive traces employed on the printed circuit board substrate, and it is quite common for the motherboard to be a multilayer printed circuit board. In any event, a large number of both signal and power contacts are commonly employed to make the necessary interconnections between the motherboard and the daughterboard.

U.S. Pat. No. 4,655,518 discloses a backplane/daughterboard connector in which a two-part connector assembly is used to interconnect corresponding traces on the motherboard and the daughterboard. The connector assembly used to interconnect the motherboard to individual daughterboards consists of a two-part member, each part having a plastic housing in a plurality of rows of contacts. Contacts in one connector have receptacle portions for mating with pins in the other connector. This connector also employs a ground shield on both connector halves. A commercial version of a connector of this type also provides for the distribution of power from the motherboard by the use of special dedicated power tuning fork contacts located on the end of connector modules. These tuning fork contacts in the daughterboard connector interface with bus blades which, in turn, interface with the backplane or daughterboard inner layers for low power applications and with external bus bars for higher power operations.

Connectors of this type also employ a plurality of rows of signal contacts. In one embodiment, four rows of signal contacts are employed. Ground planes are necessary so that the impedance for the signal interconnections remain within prescribed limits.

SUMMARY OF THE INVENTION

The instant invention provides a connector assembly for interconnecting signals, power, and ground between daughterboards and motherboards to form a backplane connector assembly. This assembly is suited for the distribution of power to individual daughterboards at any point along the mating edge of the daughterboard and is not limited to the distribution of power at a single location on the daughterboard. Furthermore, this connector assembly is suitable for use in a backplane assembly employing daughterboards having varying thicknesses, since precise alignment of the power terminal interconnection is not necessary.

Elements of the multiconductor assembly used to interconnect corresponding traces on a motherboard and a daughterboard include a motherboard signal connector, a daughterboard signal connector, and a plurality of motherboard power terminals and daughterboard power terminals. The motherboard signal connector includes a housing and a plurality of signal terminals. The daughterboard signal connector also includes a plurality of signal terminals positioned within a housing. The motherboard signal connector and the daughterboard signal connector are intermatable. The motherboard and daughterboard power terminals are positioned so that they are oriented perpendicular to the daughterboard when the motherboard and the daughterboard are mated. Alignment means are included for precisely aligning the motherboard signal terminals, but precise alignment between the motherboard and daughterboard power terminals is not necessary. In the preferred embodiments of this invention, the motherboard power terminals are located within the same housing as the motherboard signal terminals, but are positioned adjacent an opposite edge. The daughterboard signal terminals are located in a separate housing on the opposite side of the daughterboard from the daughterboard signal housing and daughterboard signal terminals. Since the daughterboard power terminals and the motherboard power terminals are located orthogonally relative to the plane of the daughterboard, precise alignment in the direction perpendicular to the daughterboard is not necessary. Therefore, the same connection configurations can be used for daughterboards having different thicknesses.

BRIEF DESCRIPTION OF THE DRAWINGS

FIG. 3 is a sectional view of the motherboard connector.

DETAILED DESCRIPTION OF THE PREFERRED EMBODIMENT

The electrical connector comprising the first embodiment of the invention depicted herein is a high speed, high density matched impedance connector having low crosstalk between adjacent signals. This connector is capable of establishing an interconnection between a plurality of separate signal and power paths on separate components such as printed circuit boards. The dimensions of the components of this connector can be chosen to match the impedance in the transmission lines interconnected such that any impedance discontinuity incidental to the interconnection can be minimized.

Figure 1:
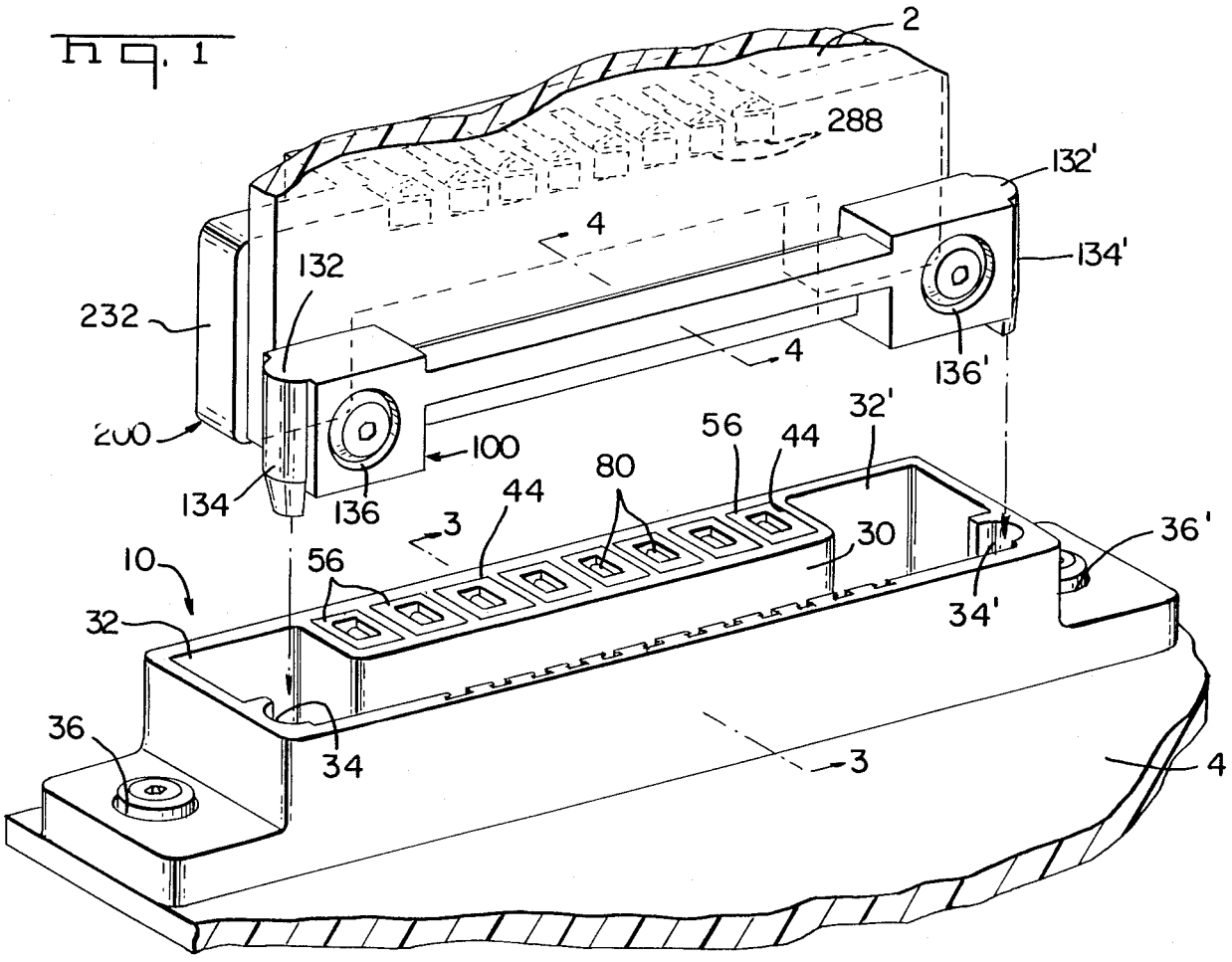
FIG. 1 is perspective view showing matable mother and daughterboard connectors in accordance with the preferred embodiment of this invention.

FIG. 1 shows the basic elements of this invention adapted to a connector assembly for interconnecting signal and power traces on a daughterboard 2 to corresponding and signal traces on a motherboard 4. This connector assembly includes a single motherboard connector 10 attached to the motherboard 4. This motherboard connector includes a separate array of power interconnection elements 80 and an array of signal interconnection elements 60, 70. A subassembly including a daughterboard signal connector 100, and a daughterboard power connector 200, are attached to the daughterboard 2. The subassembly consisting of connectors 100 and 200 attached at the end of the daughterboard 2 is insertable into mating relationship with the motherboard connector 10.

Figure 2:
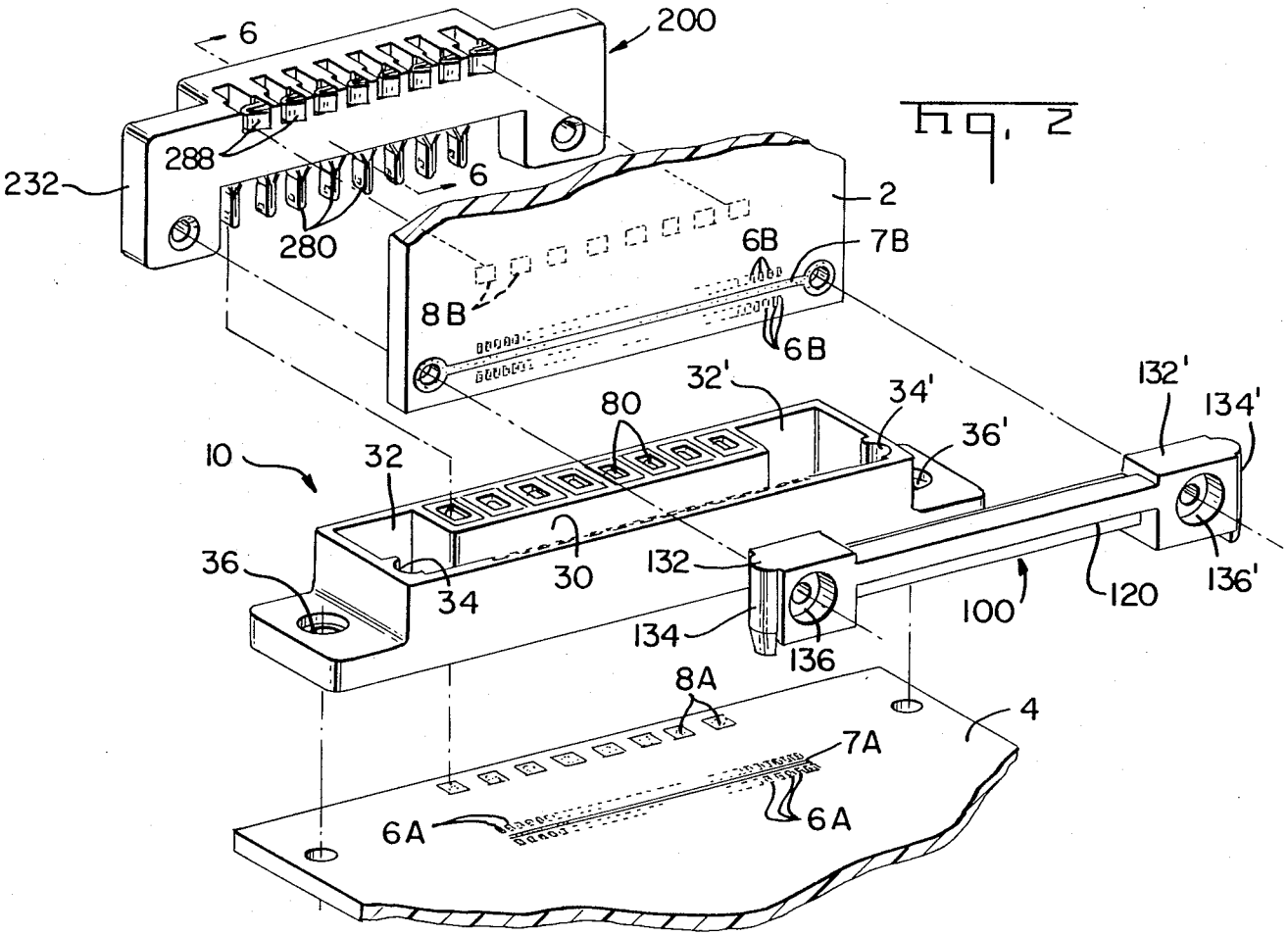
FIG. 2 is an exploded perspective view of the connectors shown in FIG. 1.
Figure 1:
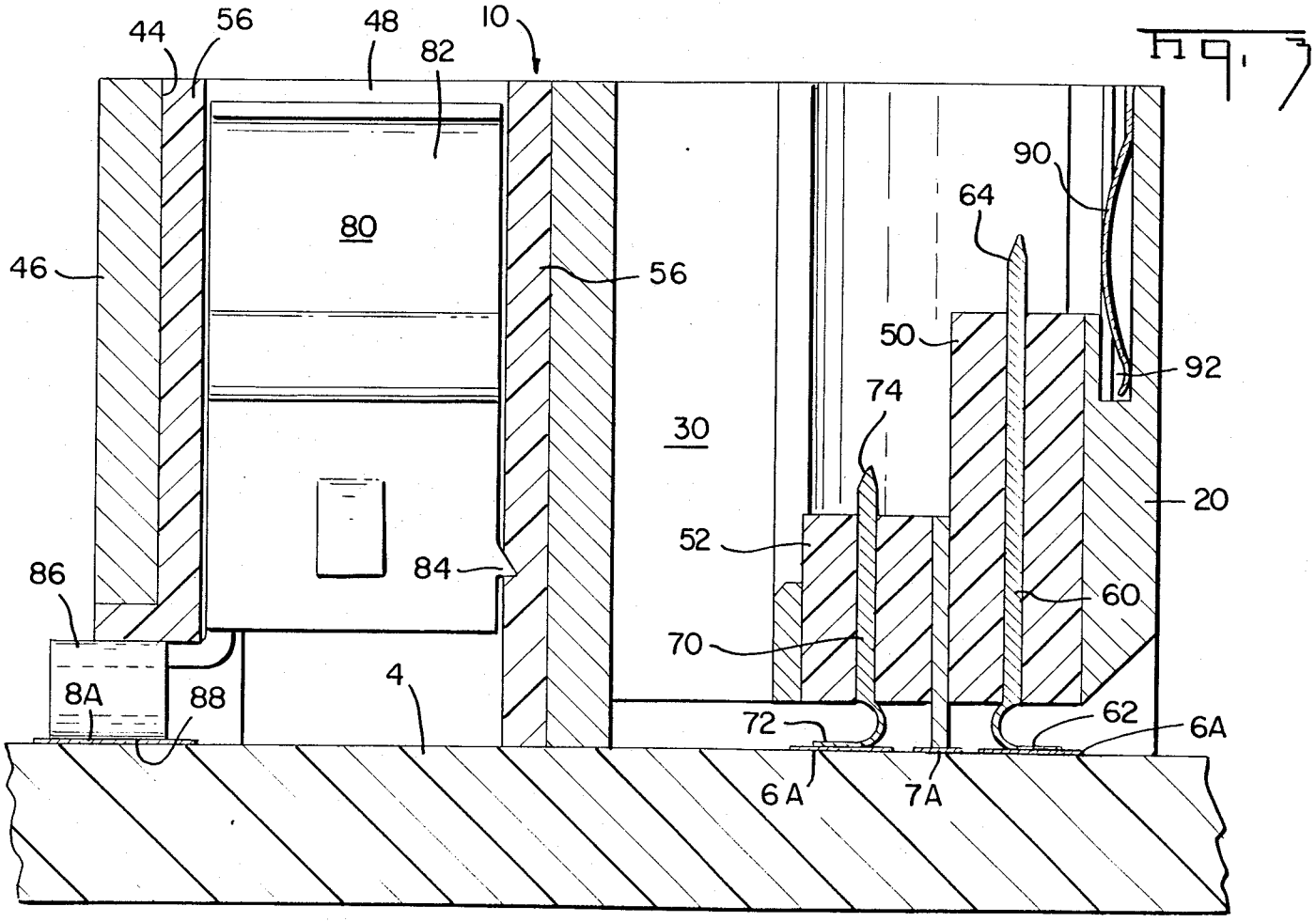

FIG. 2 is an exploded perspective view of the various components of the connector assembly illustrating the manner in which connectors 10, 100, and 200 are attached to the daughterboard 2 and the motherboard 4 in order to establish interconnection to signal pads 6*a* and 6*b* and power pads 8*a* and 8*b* located on the motherboard 4 and the daughterboard 2 respectively. The signal pads 6*a*, located on motherboard 4, are spaced from the power pads 8*a*. As shown in FIG. 2, the signal pads 6*a* are positioned in two separate rows. The signal pads 6*a* are not only significantly smaller than the power pads 8*a*, but are also much more closely spaced. Separation between the centerlines adjacent of signal pads in one embodiment of this adjacent power pads is on the order of 0.250 inches. A grounding strip 7*a* commoned to the grounding planes in the motherboard 4 extends between the two rows of signal pads and is connected to the housing 100. An array of signal traces 6*b* is located on one side of the daughterboard 2. Adjacent rows of signal traces 6*b* are separated on the daugterboard by an intermediate ground trace 7*b* similar to that for the motherboard. In this embodiment of the invention, the power pads 8*b* are located on the opposite surface of the daughterboard 2 from the signal traces 6*b*. A ground plane located within the daughterboard 2 would provide a reference plane for impedance matching within the printed circuit board.

Each of the separate connectors 10, 100, and 200 comprising this assembly, include three principal elements. Each separate connector contains a plurality of individual terminals located in an array corresponding to the conductive traces on the respective daughterboard 2 or motherboard 4. Each terminal is in turn positioned within a terminal receiving cavity of a dielectric sleeve. The dielectric sleeves are in turn located within pockets formed in a unitary housing formed of a conductive material, such as a die cast metal housing. The outer conductive housing extends not only in surrounding relationship to the array of terminals and associated dielectric sleeves, but also encircles or surrounds each individual dielectric sleeve such that each terminal is laterally surrounded by a conductive shield with the terminals and the conductive shields being separated by the intermediate dielectric sleeves. The interrelationship between terminals, dielectric sleeves, and the outer conductive housing, is shown with respect to the motherboard connector 10 by the sectional view of FIG. 3 in conjunction with the elevational sectional view of FIG. 13 and the plan view of FIG. 14. An array of signal terminals 60 and 70 are positioned in a signal portion of motherboard connector 10 separated from an array of power terminals 80 by an intermediate slot 30. The slot 30, best shown in FIG. 14, extends between cavities 32 and 32'. Cavities 32 and 32' are dimensioned to receive the end portions of the daughterboard connectors 100 and 200 and the intermediate slot 30 is positioned to receive the lower edge of the daughterboard 2. The array of signal terminals includes one outer row of signal terminals 60 and an inner row of signal terminals 70. In this embodiment of the invention, the outer row of signal terminals 60 are longer than the signal terminals 70 in the inner row. Terminals 60 are generally rectangular in cross section and have a tapered section 64 at one end and a surface mount foot 62 suitable for reflow soldered interconnection to the outer row of signal pads 7*a*. The inner row terminals 70 also include a tapered portion 74 at one end and a surface mount foot 72 at the opposite end. In the first embodiment of this invention, the signal terminals 60 and 70 are formed of a high copper alloy such as any number of high copper alloys manufactured by Olin Brass, Olin Corporation. Other materials such as beryllium copper could also be employed. Power terminals 80 are located in a separate power section of the motherboard connector 10. Each of the power terminals 80 includes separate spaced apart spring biased wings 82 and 82'. An integral contact leg 86 having a contact foot 88 provides means for surface mount reflow solder interconnection to the power pads 8*a*. Retention barbs 84 and 84' formed on wings 82 and 82' retain the individual power terminals within associated dielectric sleeves.

Figure 8:
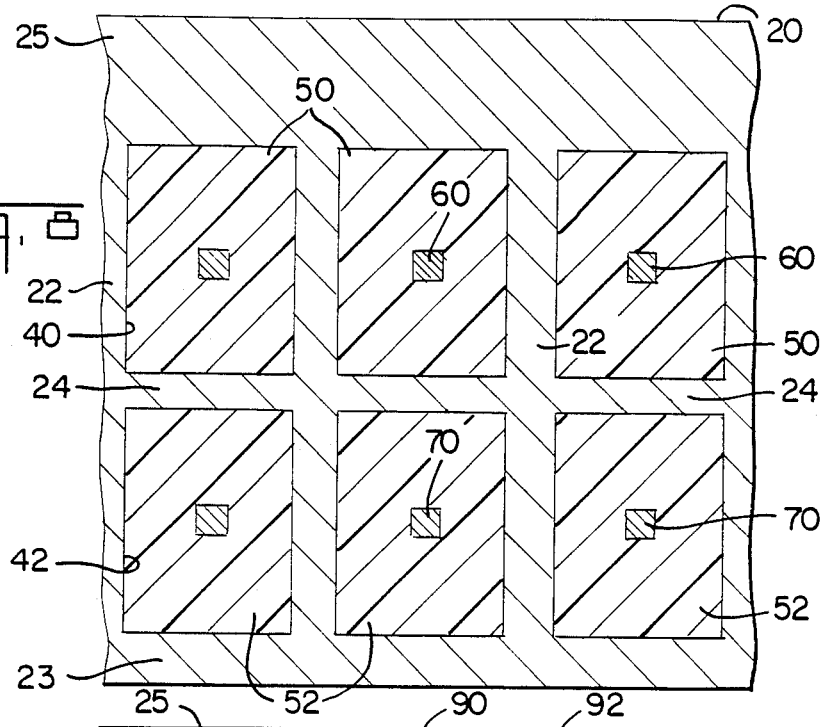
FIGS. 8, 9, and 10 are sectional views taken along section 8—8, 9—9 and 10—10 in FIGS. 7 and 4.

As shown in the sectional view of FIG. 3, individual signal pins 60 and 70 are located within separate dielectric sleeves 50 and 52. The dielectric sleeves 50 and 52 each have a terminal receiving cavity generally centrally disposed therein. Each dielectric sleeve 50 and 52 extends below the major portion of the length of the respective terminals 60 or 70. In each case, the surface mount foot 62 or 72 extends below the lower face of the respective dielectric sleeve 50 or 52 and the upper tapered portion 64 and 74 extends beyond the upper face of the corresponding dielectric sleeve. As best shown in FIG. 8, each dielectric sleeve 50 and 52 is generally rectangular in cross section and is received within a respective pocket 40 and 42 of the outer housing 20. The sleeves can be fabricated from a material having a high dielectric strength or low dielectric constant. Suitable dielectric materials would be methylpentene polymer or polytetrafluoretheylene. The respective pockets 40 and 42 also have a generally rectangular cross section and conform to the outer contour of the corresponding dielectric sleeves 50 and 52. Pockets are defined by a plurality of walls or ribs 22 extending orthogonally between laterally extending walls 23, 24, and 25. The dielectric sleeves 50 and 52 not only separate the terminals 60 and 70 from the walls 23, 24, and 25, but also maintain a prescribed spacing between the terminals 60 and 70 and the conductive walls 23, 23, and 25 which form a common ground. As such, the terminals 60 or 70 and dielectric 50 and 52 in each pocket exhibit a generally coaxial configuration along the length of the terminal 60. When the spacing between the housing walls and the intermediate terminals 60 and 70 remains axially uniform and when the dielectric constant of dielectric sleeves 50 and 52 remains axially uniform, the impedance along the major portion of the respective signal terminals 60 and 70 will remain substantially constant.

Figures 12, 13, 14:
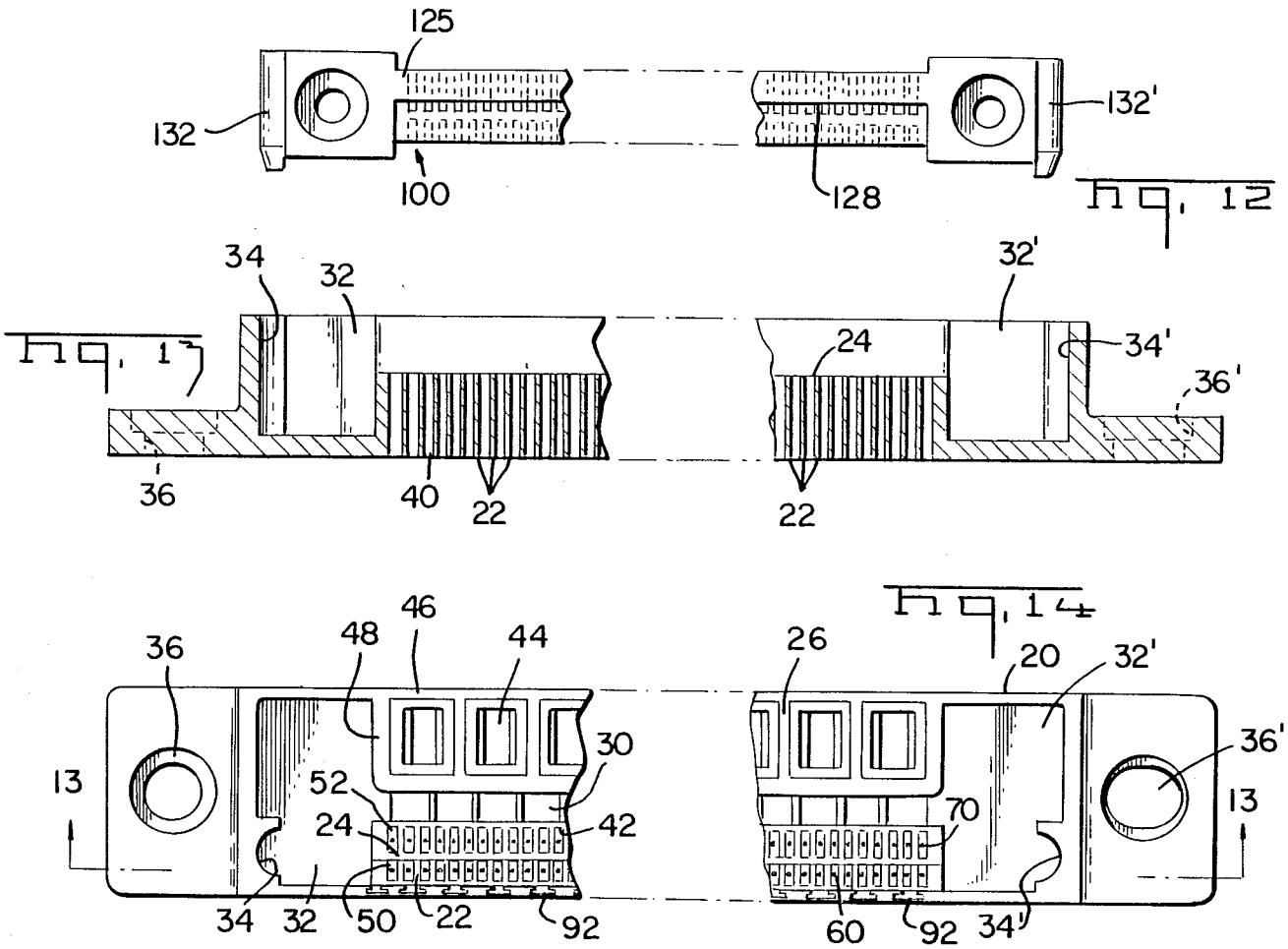
FIG. 12 is a top view of the daughterboard signal connector.
FIG. 13 is a side elevational view of the motherboard connector with the section taken through signal terminal portion, with the pins removed for clarity.
FIG. 14 is a top plan view of the motherboard connector.
Figure 15:
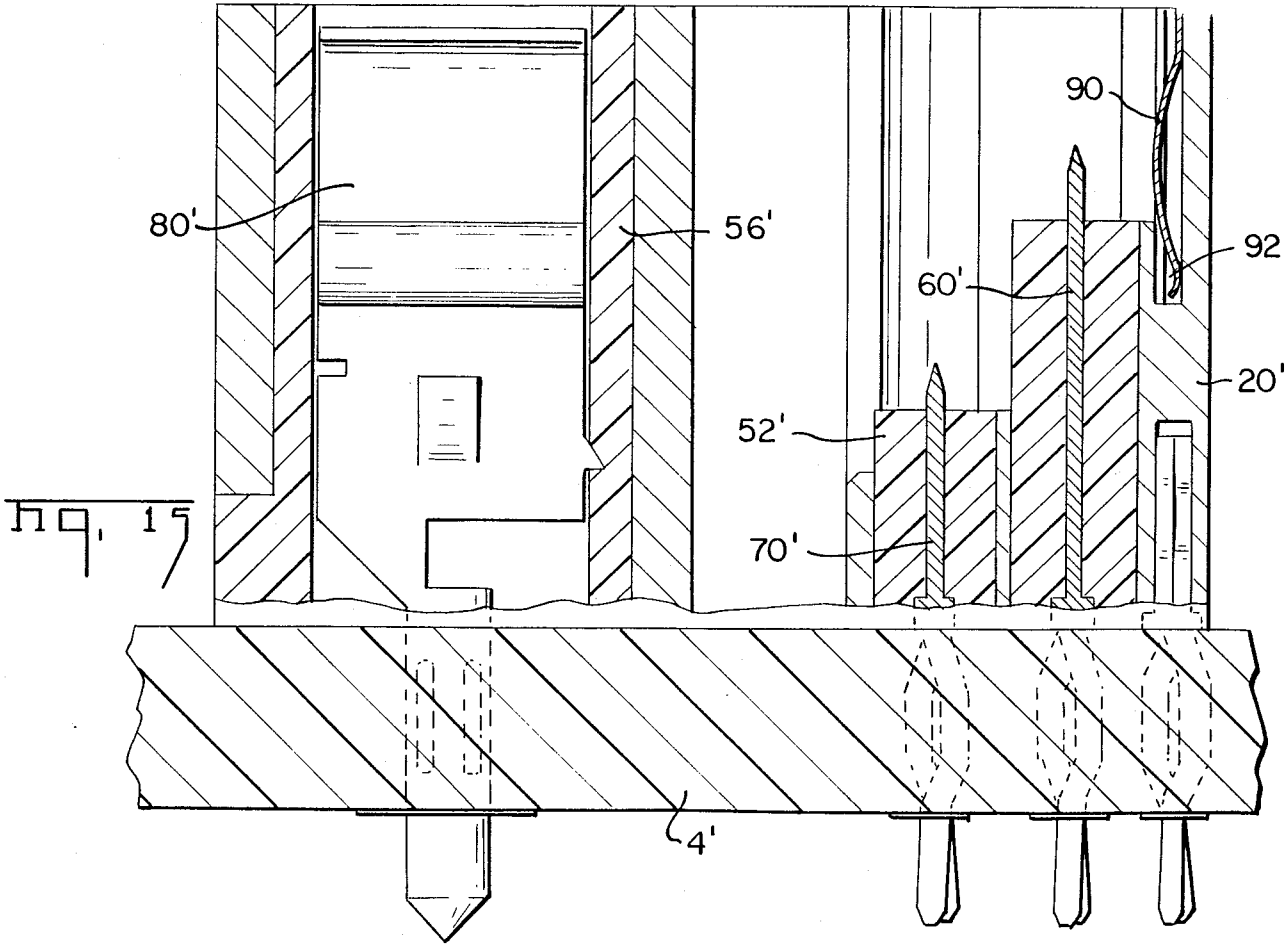
FIG. 15 is an alternate embodiment of the motherboard connector having through-hole rather than surface mount terminals.
Figure 16:
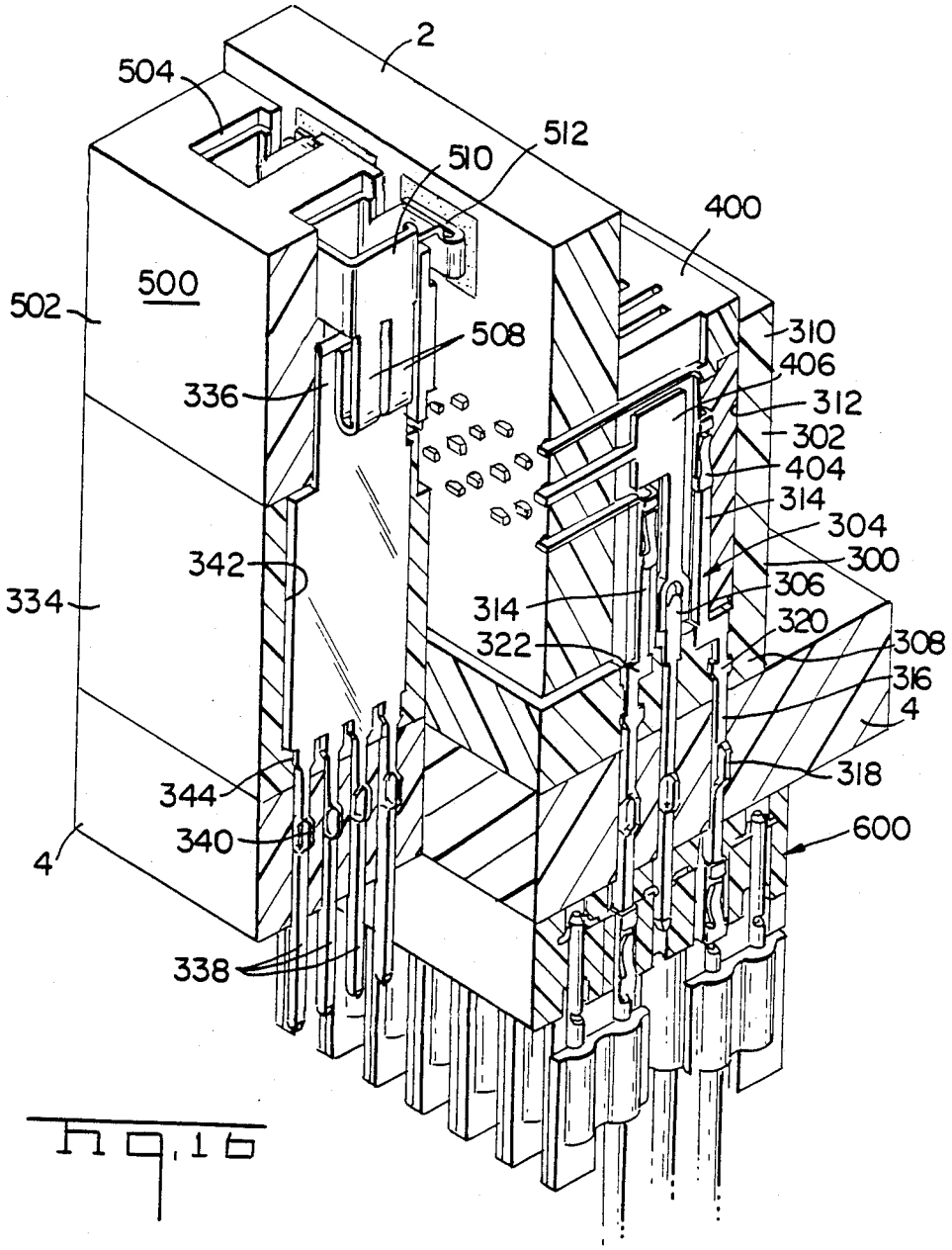
FIG. 16 is a perspective view of one embodiment of a backplane connector assembly including a motherboard backplane connector, a daughterboard signal connector, a daughterboard power connector and a coaxial input connector, all assembled to a motherboard and one daughterboard.
Figure 17:
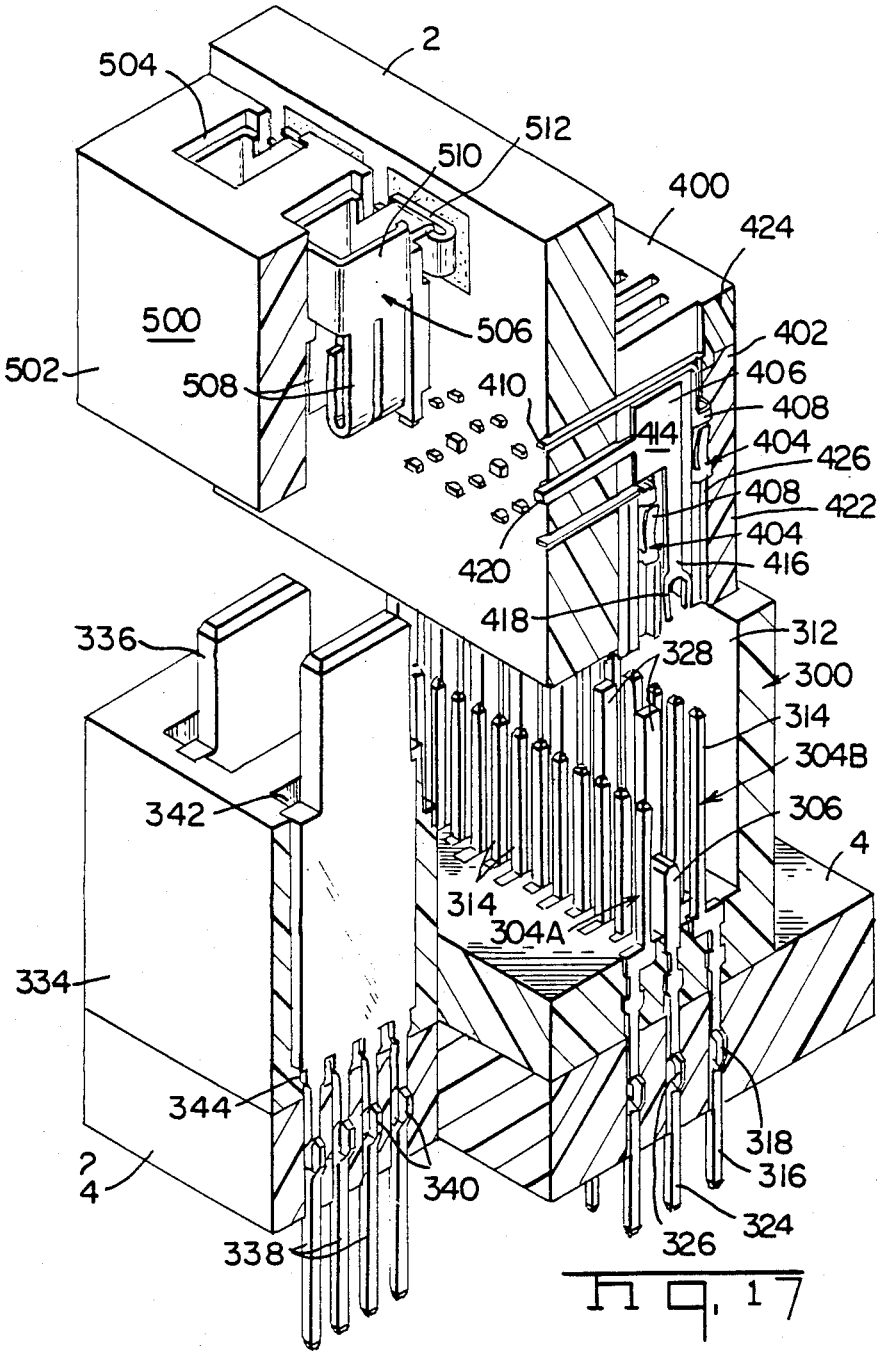
FIG. 17 is an exploded perspective view of the motherboard connector with the daughterboard power and signal connectors positioned for mating.
Figure 18:
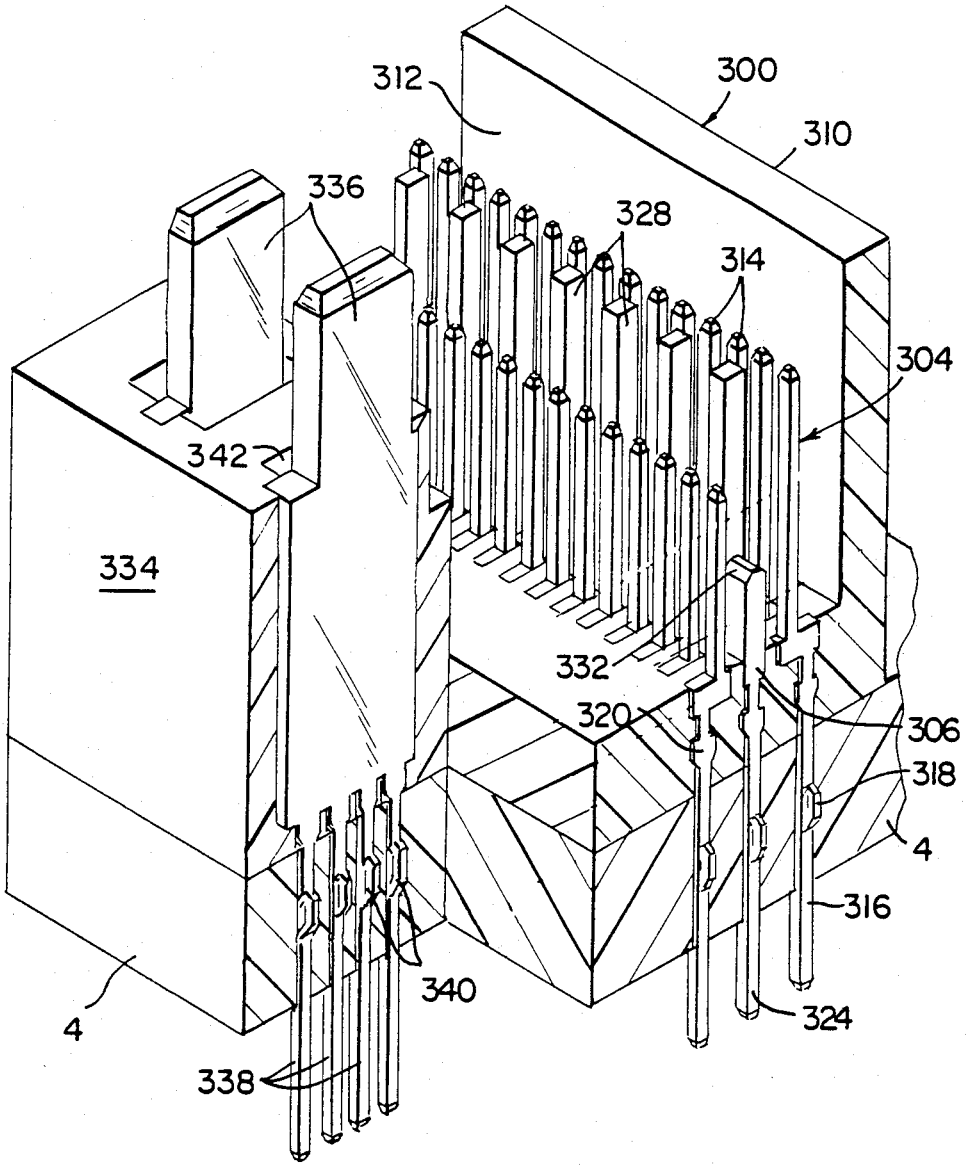
FIG. 18 is a perspective view of the motherboard backplane connector.

As shown in FIGS. 1, 3 and 14, the motherboard connector 10 contains not only a signal terminal array, but also a power terminal array on the opposite side of slow 30. Power terminals 80 within power dielectric sleeves 56 are positioned within power terminal pockets 44 formed within the unitary cast housing 20. FIG. 3 shows the relationship between power terminals 80 and signal terminals 60 and 70. The power terminal retention bars 84 engage the dielectric sleeves 56. These dielectric sleeves 56 are in turn surrounded by cast walls 46 and 48 in much the same manner as for the signal terminal array. The upper end of the power terminal pockets 44 is open with the power terminal spring contact wings 82 and 82' being disposed to engage a mating contact inserted into the power terminal pocket 44. The surface mount leg 86 and surface mount foot 88 extend from the bottom of the power pocket 44 and are positioned to engage a power pad 8*a*. In the first embodiment of this invention, each power terminal is capable of carrying ten amps. A single connector in accordance with this invention could contain 40 power terminals, and 400 amps could be transmitted between boards by this connector.

Whereas the motherboard connector 10 contains both signal and power terminals positioned within a single unitary cast housing 20, separate connectors 100 and 200 are employed as signal and power connectors to the traces on daughterboard 2. Daughterboard signal connector 100 is adapted to mate with the signal terminal array and motherboard 10 and daughterboard power terminal 200 is similarly adapted to mate with the power terminal array in the motherboard connector 10. As shown in FIG. 1, the daughterboard signal connector 100 is mounted on an opposite side of daughterboard 2 from the daughterboard power connector 200.

Signal connector 100 has two rows of signal terminals 160 and 170 received within dielectric sleeves 150, 152, and 154, in turn positioned within an outer cast housing 120. The upper or outer terminals 160 are significantly longer than the lower or inner terminals 170. The outer terminals 160 have an elongate shank 165. A U-shaped female contact socket 164 is located at one end of terminals 160. A surface mount foot 162 suitable for reflow soldering is positioned at the other end of the outer terminal 160. Inner terminal 170 also has a U-shaped female contact portion 174 at one end and a surface mount foot 172 suitable for reflow soldering at the opposite end. The terminals 160 and 170 are also preferably formed of a high copper alloy such as any number of high copper alloys manufactured by Olin Brass, Olin Corporation.

Each of the daughterboard signal terminals 160, 170 and its surrounding dielectric sleeve or sleeves 150, 152, 154 is positioned within the outer signal pockets 140 and inner signal pockets 142 respectively. Although located in surrounding relationship to the respective signal terminals 160 and 170, the signal pockets 140 and 142 do not have a simple rectangular cross section. The comparatively complex configuration of signal pockets 140 and 142 is due to the necessity of positioning the U-shaped female contact sockets 164 and 174 within the pocket while still maintaining adequate separation between the terminal mating section and the outer walls of the housing such that an impedance mismatch does not occur at the point where the daughterboard signal terminals are mated to the motherboard signal terminals. The spacing at this mating point must also take into account that the total thickness of the signal conductor is increased at the point of mating since the sockets 164, 174 overlap the ends 64, 74 of the signal pins 60, 70.

Figure 4:
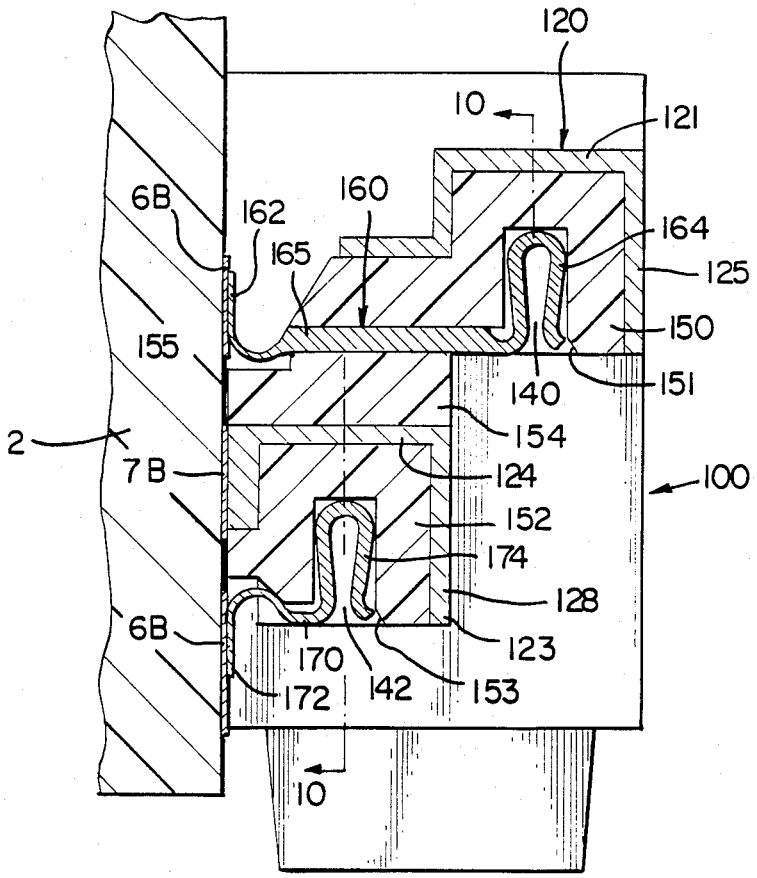
FIG. 4 is a sectional view showing the daughterboard signal connector.

As shown in FIG. 4, the dielectric sleeves surrounding each outer signal terminal 160 comprises a two-piece rather than a one-piece dielectric sleeve. Sleeves 150 and 154 are positioned in adjoining relationship to surround much of the outer signal contact 160. Sleeve 150 has a closed end socket cavity 151 extending inwardly from the face of sleeve 150. This socket cavity provides clearance for receiving the U-shaped socket portion 164 of terminal 160. The other half of the upper signal terminal dielectric sleeve is formed by an insert 154. Sufficient clearance is provided between dielectric sleeve half 150 and insert 154 to provide clearance for the shank portion 165 of the outer signal terminal. Note however, that the portion of the signal terminal shank 165 extending between dielectric sleeve elements 150 and 154 is surrounded on four sides by dielectric material. Sleeve insert 154 has an undercut section 155 which provides clearance for the surface mount foot 162 on terminal 160 as best shown in FIG. 4. An alternate construction of this portion of the daughterboard signal connector is shown in FIG. 21. The inner terminal dielectric sleeve 152 also has a socket cavity 153 for receiving U-shaped spring action socket portion 174 of the inner signal terminal 170. The remainder of the terminal 170 extends on the exterior of one face of sleeve 152 but with the exception of the surface mounting foot 172, the terminal 170 is surrounded on three sides by dielectric material in the daughterboard signal connector 100.

The daughterboard power terminal 200 is configured to mate with the power terminal array in motherboard housing 10. Positioned on the opposite side of the daughterboard 2 from the daughterboard signal connector 100, the daughterboard power connector 200 also comprises a unitary metal housing having a plurality of sleeves 256 containing power terminals 280 located within power terminal pockets 244. Power terminals 280 have projecting blades 282 and 282' suitable for insertion between spring contact wings 82 and 82' on the motherboard connector 10. Projecting blades 282 and 282' are narrower than spring biased wings 82 and 82'. Therefore, the lateral position of blades 282 and 282' relative to wings 82 and 82' is not critical. Daughterboard thickness is, therefore, not critical. The lateral positioning of blades 282 and 282' relative to wings 82 and 82' varies with the daughterboard thickness and the wide range possible for this configuration thus accounts for daughterboard thickness. These blades extend below the lower face of the power terminal outer housing and the dielectric sleeve 256. Power terminal foot 288, located on the opposite end of terminal 280, is positioned for surface mount soldered engagement to a power pad **8*b*** located on the daughterboard.

Figure 7:
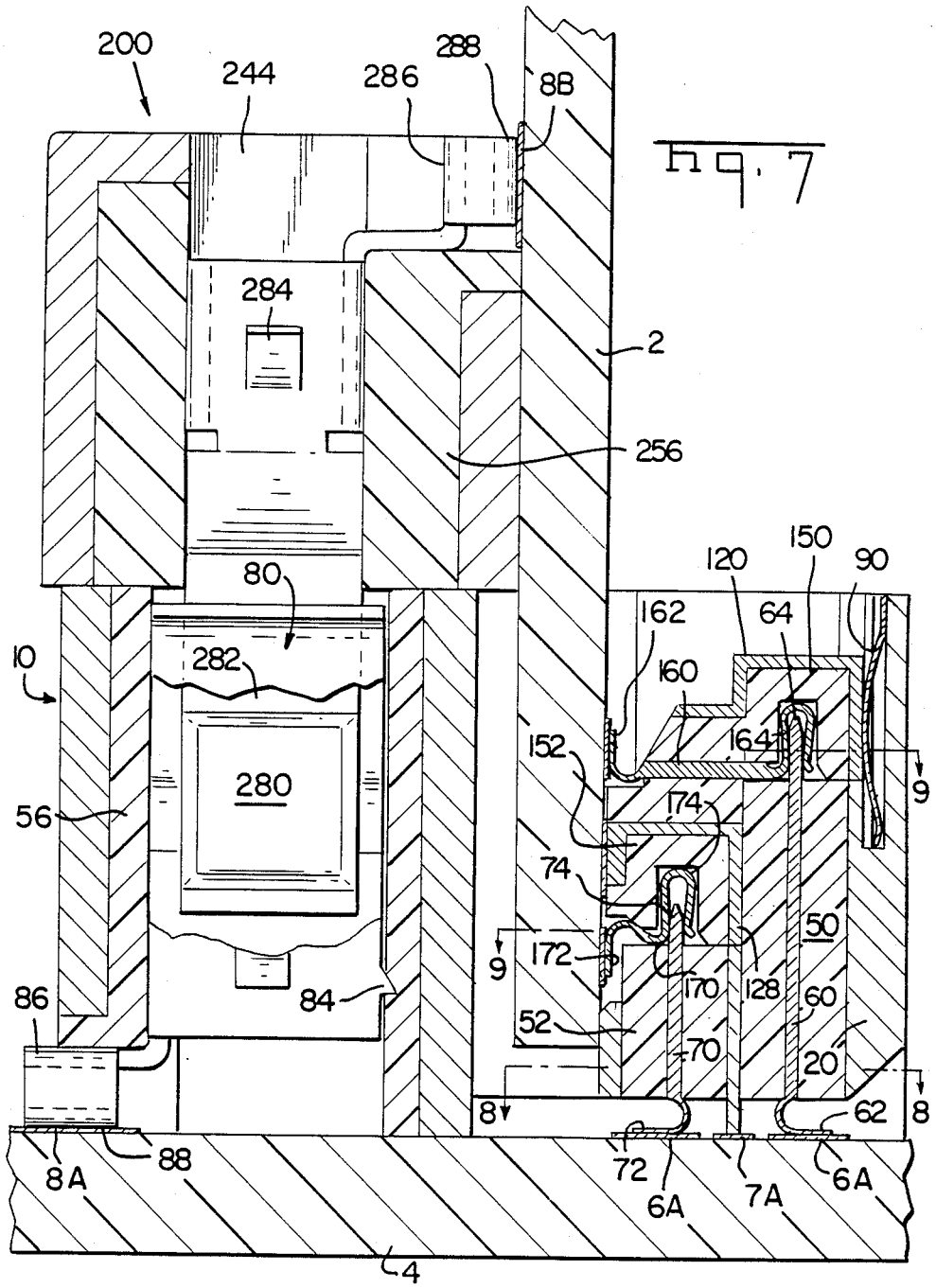
FIG. 7 is a sectional view taken in elevation showing the mated motherboard and motherboard signal and power connectors.
Figure 9:
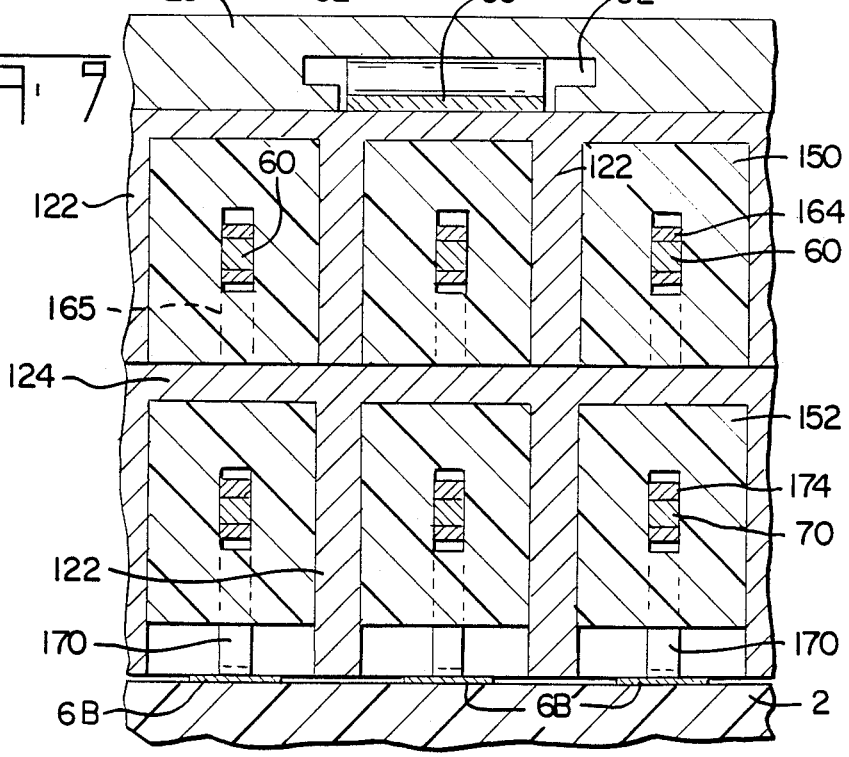
Figure 10:
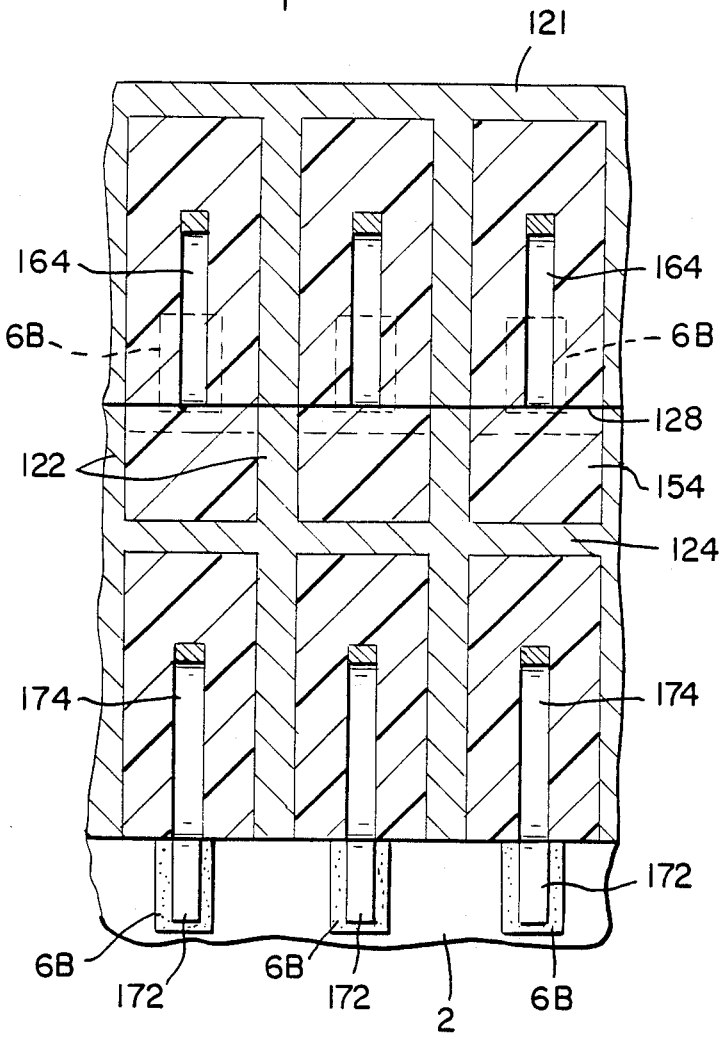
Figure 11:
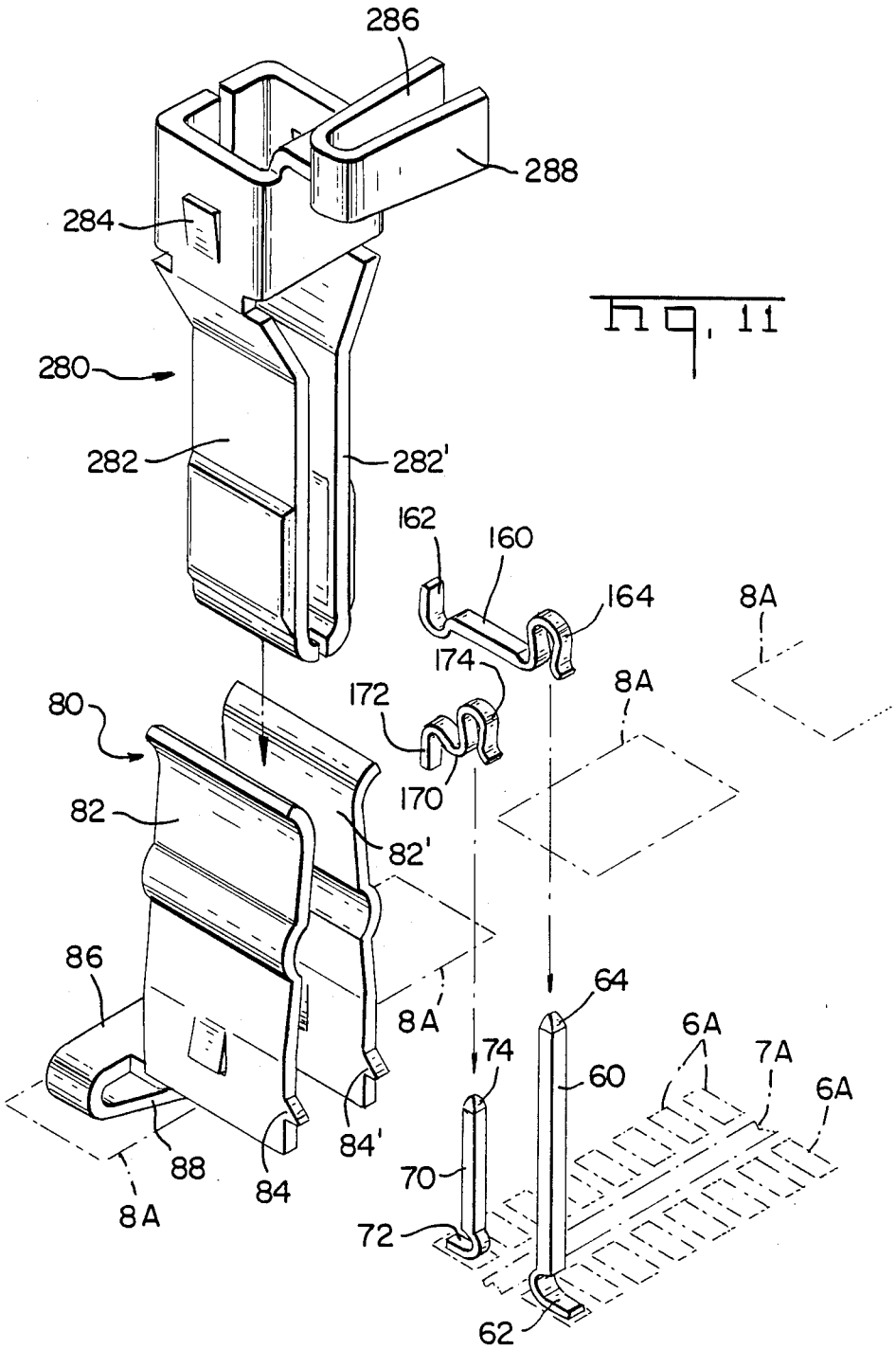
FIG. 11 is an exploded perspective view showing only the terminals used in the motherboard and daughterboard connectors and showing the relative position of each.

The mating configuration of connectors 10, 100, and 200 is shown in FIG. 7 and in FIGS. 8, 9, and 10, with connectors 100 and 200 attached by means of screws or other conventional fastening elements at the lower edge of the daughterboard, the daughterboard 2 is insertable into position in the motherboard connector 10. Relatively rigid daughterboard connectors 100 and 200 are thus secured to opposite sides of the daughterboard and will tend to minimize warpage of the relatively thinner daughterboard. As shown in FIGS. 1, 2, and 13, flange cavities 32 and 32' provide suitable clearance for the board attachment flanges 132 and 132' on connector 100 and 232 and 232' on connector 200. A cylindrical mating groove 34 and 34' on each side of the motherboard housing is dimensioned for close fitting engagement with cylindrical surfaces 134 and 134' at the exterior ends of the metal housing 100. These mating surfaces serve to key and align the connector housing to position corresponding mating terminals in alignment. Precise alignment is especially important because of the large number of closely spaced terminals employed in the two mating connectors. The conical lower portion of surfaces 134 and 134' laterally aligns the signal contacts in both housings. The upper cylindrical surfaces then maintain this precise alignment as the contacts are fully mated. The lower conical portions of the alignment sections 134, 134' extend below the lower surface of the daughterboard signal connector 100 and are dimensioned to stub against the motherboard connector 10 before the pins 60 and 70 stub against the daughterboard connector or contacts 160 and 170. This feature prevents damage to the connectors as a result of an improper attempt to mate them. For example, thermal expansion can result in a significant dimensional mismatch when a new daughterboard and connector is inserted into a motherboard connector which has been heated during use.

Figure 5:
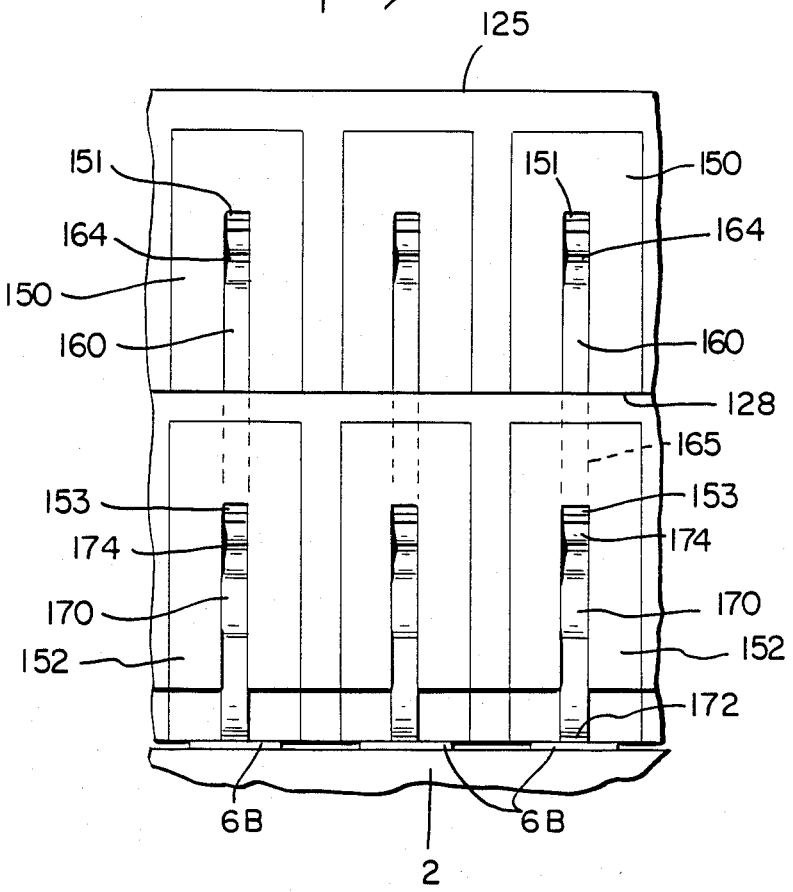
FIG. 5 is a bottom view of the daughterboard signal connector.
Figure 6:
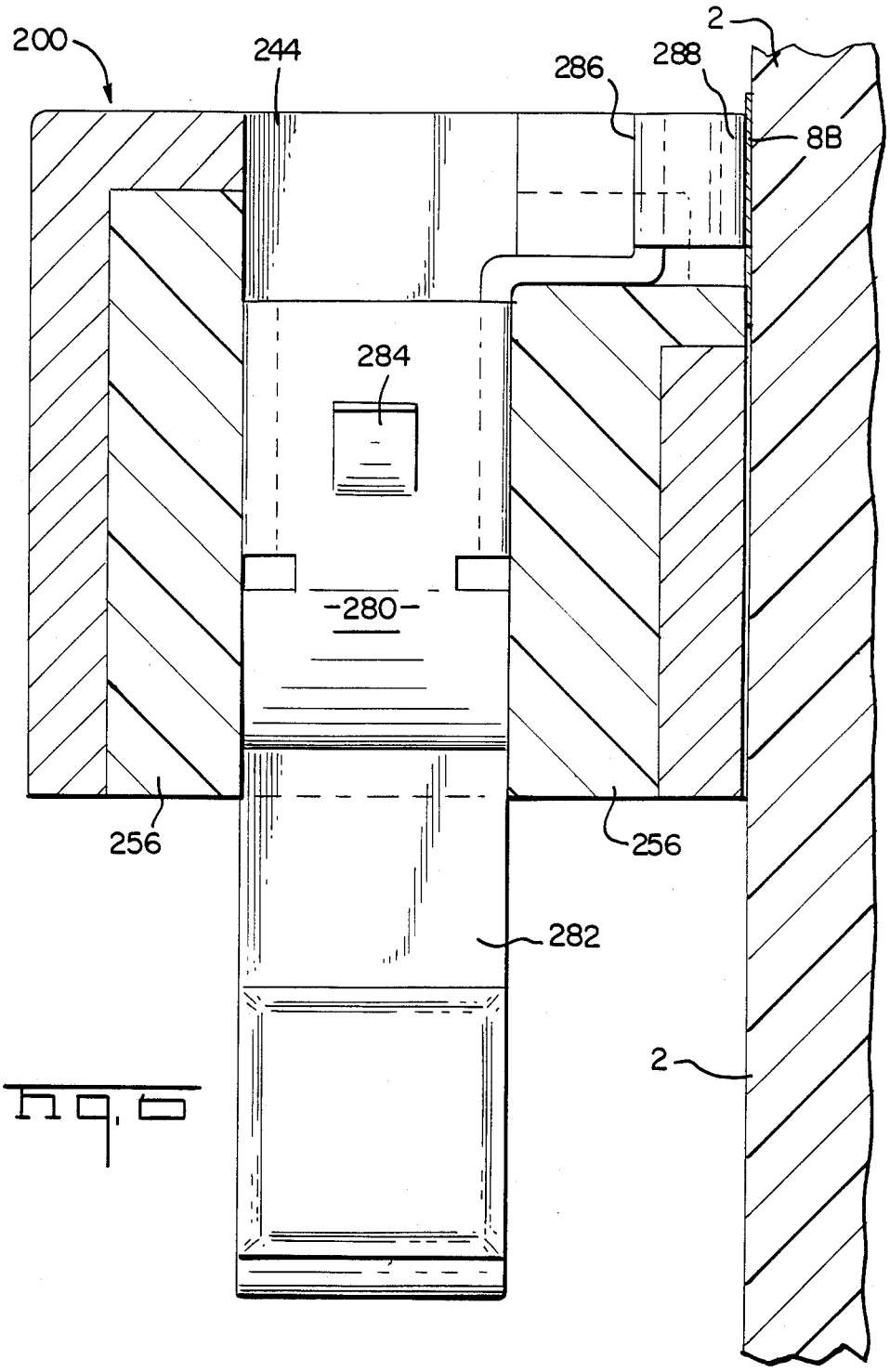
FIG. 6 is an elevational sectional view of the daughterboard power connector.

Mating between the terminals in the three connectors is demonstrated in FIG. 7. The tapered ends of the signal terminals 60 and 70 in the motherboard connector 10 are received within the resilient sockets 164 and 174 on the signal terminals 160 and 170. In order to provide the right angle interconnection between the orthogonal motherboard 4 and daughterboard 2, the outer longer motherboard signal pins 60 mate with the upper or outer longer signal pins 160 attached to the daughterboard. Similarly, signal terminals 70 interconnect with signal terminals 170. When the signal connectors are mated, as shown in FIG. 7, the dielectric sleeves 50 and 150 abut as do the dielectric sleeves 52 and 152 to surround the signal terminals and establish a dielectric between the signal terminals and the surrounding walls of the conductive outer housings 20 and 120. Since the walls 22, 122, 24, and 124, extend into abutment with the printed circuit boards with the connectors attached by solder to the ground plane of the board (see FIGS. 9 and 5), the outer housing surrounds the terminals and the intermediate dielectric sleeves along substantially their entire length. FIGS. 8, 9, and 10 are cross sectional views taken through the signal portions of the intermated connectors to demonstrate the substantial coaxial character of the connectors.

A plurality of springs 90, located in spring retaining slot 92 located on the exterior walls of the motherboard connector 10, engages the outer surface of the connector housings 120 and 20. Thus, all three housings are grounded. Suitable interconnection can be established through pads on the printed circuit board to the ground plane in the printed circuit board, thus maintaining the entire housing at the common electrical potential.

These embodiments not only provide a matched impedance interconnection between printed circuit boards, but it also provides for interconnection of extremely closely spaced signal pads. For example, in these embodiments of this invention, adjacent signal pads are spaced apart on 0.050 inch centerlines. Therefore, the terminals must also be spaced apart by the same distance. For a connector having an essentially constant impedance of 50 ohms, signal pockets 40, 42 having a rectangular cross section preferably would have a width of 0.040 inches and length of 0.090 inches. The walls 22 between adjacent signal terminals would then have a thickness of 0.010 inches. Such relatively thin walls approach if not exceed the capabilities of conventional molding and die casting technology. Even if the unitary signal terminal housings with walls 22, 23, 24, 123, 124, and 125 having a thickness of 0.010 can be fabricated, the cost of making even simple structures would be excessive or prohibitive. Such closely spaced arrangements do not provide adequate room for separate shields or ground planes surrounding each terminal position in an insulated connector housing. By employing a subsequently cast or molded outer housing, this invention achieves the close spacing required. The method of sequentially casting and molding the components of these embodiments of this invention is disclosed in copending U.S. patent application Ser. No. 096,792 filed Sept. 11, 1987.

The backplane connector assembly comprising a third embodiment of this invention is intended to establish an interconnection between two orthogonal printed circuit boards employed in a backplane assembly used in a computer or similar electronic component. The connector assembly comprising the third embodiment of this invention is intended to interconnect both power and signal to both boards. The connector assembly includes a backplane connector assembly consisting of a motherboard backplane connector 300 and daughterboard backplane signal and power connectors, 400 and 500 respectively, connectors for making signal interconnections and for interconnecting power to both the motherboard 4 and to one or more daughterboards 2. This connector assembly is suitable for use with signal contacts spaced apart by a distance of 0.050 inch and can be employed using power contacts intended to deliver 5 amps to both the motherboard 4 and to the daughterboard 2.

A separate connector 600 can be employed to interconnect signal circuit conductors to the motherboard 4 and to the backplane signal connector used on the motherboard. The third embodiment of this invention employs a coaxial motherboard signal connector 600. It should be understood, however, that more conventional means of interconnecting signal conductors to the motherboard 4 can also be employed, for example individual signal wires can be soldered or wire-wrapped directly to the pins employed in this assembly.

Not only will the connector assembly comprising the third embodiment of this invention depicted herein deliver both power and signals to a backplane assembly consisting of a motherboard 4 and one or more daughterboards 2, but this connector assembly can also be employed in a manner such that the impedance of the signals transmitted through the connector assembly will match the impedance of the component with which the backplane assembly is used. For example, the third embodiment of this invention is intended for use in a backplane connector assembly in which a controlled impedance of 75 ohms is required.

Individual components of this connector assembly will now be described individually in more detail.

The motherboard backplane connector 300 has a plurality of signal contacts 304 and a ground plane contact or ground bus 306, each mounted in an insulative housing 302 formed from a material such as Ryton. The insulative housing 302 has a base 308 through which both the signal contacts 304 and the ground bus 306 extend and a lateral upwardly extending wall 310 which forms a cavity 312 along the upper side of the motherboard backplane connector 300. Each signal contact 304 is in the form of a pin having an upper section 314 and a lower section 316. The lower section 316 of each signal pin 304 includes a spring contact 318 adapted to make interconnection with a plated through hole in the printed circuit motherboard 4. It should be understood, however, that the lower portion 316 of the signal contacts 304 can have other configurations, such as a conventional solder pin configuration. The lower portion 316 of each signal pin contact 304 has barbs 320 for securing the signal contact pin 304 in the lower base 308 of the insulative housing 302 of the motherboard backplane connector 300. The lower section 316 of each signal pin contact 304 is offset from the upper pin section 314 by a central dogleg 322, which is located at the top of the base 308. Since the upper pin section 314 and the lower pin section 316 can extend from the dogleg 322 at different points, the signal contact pins 304 can be formed so that the upper sections 314 are in line whereas the lower pin sections 316 are offset or staggered.

Four rows of lower contact pins 316 are formed with the lower pin sections 316 in adjacent rows being mutually spaced apart by a distance of 0.300 inch. Note, however, that the upper contact pin sections 314 are all spaced in a single row with a spacing of 0.050 inch. Thus, the upper contact pin sections 314 can be closely spaced whereas the lower section 316 can be spaced apart by a distance which makes the fabrication of traces on the printed circuit motherboard 4 easier.

The ground bus 306, positioned between inner and outer rows 304A and 304B of signal contact pins 304, also has a plurality of depending legs 324 which are of the type suitable to form a spring contact with plated through holes in a printed circuit motherboard 4. As with the signal contact pins 304, these spring contacts 326 can be replaced by a through hole solder pin configuration. The single ground bus 306 formed in the motherboard backplane connector 300 extends laterally along the length of the base 308 and extends upwardly into the cavity 312 formed on the upper side of the insulative housing 302. A plurality of posts 328 spaced apart by a distance of 0.300 inch extends upwardly from the upper portion of the ground plane contact or bus 306. The width of these pins is the same as the width of the ground plane bus 306. A beveled section 332 is formed on the upper edge of the bus 306 between adjacent upstanding posts 328. The motherboard backplane connector 300 is configured such that the upper signal contact pins 314 are equally spaced apart from the ground bus 306. The lower signal contact portions 316 are, however, spaced from the ground plane legs 324 by different distances.

In the third embodiment of this invention, the motherboard backplane connector 300 includes a power section integral with the motherboard signal connector section. The motherboard backplane insulative housing 300, in addition to containing apertures for receiving the signal pins 304 and the ground bus pins 324, includes a power section 334 containing a plurality of pockets 342 for receiving male power blades 336 and apertures 344 for receiving through hole legs 338. A plurality of through hole legs 338 extend from each power blade 336 which is located in a pocket 342 on the top of the power section 334 of the insulative housing. The plurality of legs 338 provide ample cross-sectional area for conducting power from the power traces in the motherboard 4 up through the single blade which is located at a right angle relative to the daughterboard 2. Each leg 358 has a resilient integral spring section 340 for contacting the plated through holes in the motherboard 4.

The daughterboard backplane signal connector 400 has a insulative housing 402 formed of a material such as Ryton and has a plurality of signal and ground contacts, 404 and 406 respectively, positioned therein. The signal contacts 404 each have a box type receptacle 408. The signal contacts 404 each have signal contact legs 410 extending at right angles with respect to the receptacle contact portion 408. Since the length of the upper portion of the signal pins 314 in the motherboard backplane connector 300 is longer for the rows 304B on the outer portion of the ground plane bus 306 than for rows 304A on the inner side of the ground plane 306, the receptacle contact portions 408 are not located at the same height. The legs 410 extending from the receptacle portions of the daughterboard signal contacts are staggered in a similar configuration to the lower signal sections 316 of contacts 304 which establish interconnection to the traces on the motherboard 4.

Instead of a single continuous ground plane in the daughterboard signal connector 400, a plurality of ground blades 406 are located between the signal legs 410 having the greatest spacing. Each blade 406 has a central section 414 with a lower vertically extending segment or arm 416 which extends between the receptacle portions 408 of the signal contacts in the outermost rows. This vertically extending arm of the blade has a bifurcated spring contact 418, located at its lower end, suitable for establishing a resilient contact with the base of the ground plane bus 306 in the motherboard connector 300. The central section 414 of each blade 406 extends above the innermost receptacles 408 and includes a horizontal arm segment 420 extending adjacent to the right angle portion of the leg 410 of the outermost receptacle contact 408. These ground blades 406 are located only between the daughterboard signal contacts 408 having legs spaced apart by a distance greater than the contacts relatively more closely spaced apart. Note that the leg 420 of each ground blade 406 is surrounded by six equally spaced signal contact legs 410 which are arranged in a hexagonal configuration surrounding each ground blade leg 416. Each ground blade 406, when mated with the ground plane 306 of the motherboard connector 300, extends between adjacent upwardly extending posts 328. Note that the ground blade configuration and the ground post configuration forms a spacing between signal contacts 404 and the ground such that a constant impedance is maintained for the signals transmitted including the motherboard backplane connector 300 and the daughterboard signal connector 400 through the backplane connector assembly.

The daughterboard signal housing 402 comprises a multi-part insulated member consisting of a base 422 and at least one cap member 424. In the third embodiment of this invention, a single base member 422 is employed and a plurality of side-by-side cap members 424 are securable to the single base member. The base member 422 has two rows of cavities 426 for receiving a signal contact. Cavities in each row are spaced apart by a nominal spacing. In the preferred embodiment of this invention, this spacing is 0.050 inch between the centerline of adjacent cavities 426. The upper portion of each of these cavities is dimensioned to receive the receptacle portion 408 of each signal contact 404.

The daughterboard power connector 500 is completely separate from the daughterboard signal connector 400. The daughterboard power connector 500 includes a housing 502 containing a plurality of side-by-side cavities 504, each of which receives a single daughterboard power contact 506 which is surface mounted to power traces in the daughterboard 2 through surface mount pads. The individual power contacts 506 in the daughterboard power connector 500 each have dual U-shaped contact legs 508 extending downwardly and located at right angles relative to the daughterboard 2. Each U-shaped leg 508 is resilient and is adapted to receive a single blade delivering power from the motherboard 4. Note that the width of the motherboard power blades is such that contact can still be established even though the motherboard power blades are mated at different lateral positions relative to the female daughterboard power contacts 506. Thus, the power configuration is not dependent upon the use of a daughterboard 2 having a specified thickness. The resilient spring legs 508 in the daughterboard receptacle contacts 506 project downwardly from a box section 510 in the stamped and formed power contact 506. A surface mount foot 512 having a reversely bent configuration extends orthogonally relative to the box section 510 to establish contact with a surface mount power pad.

Figure 19:
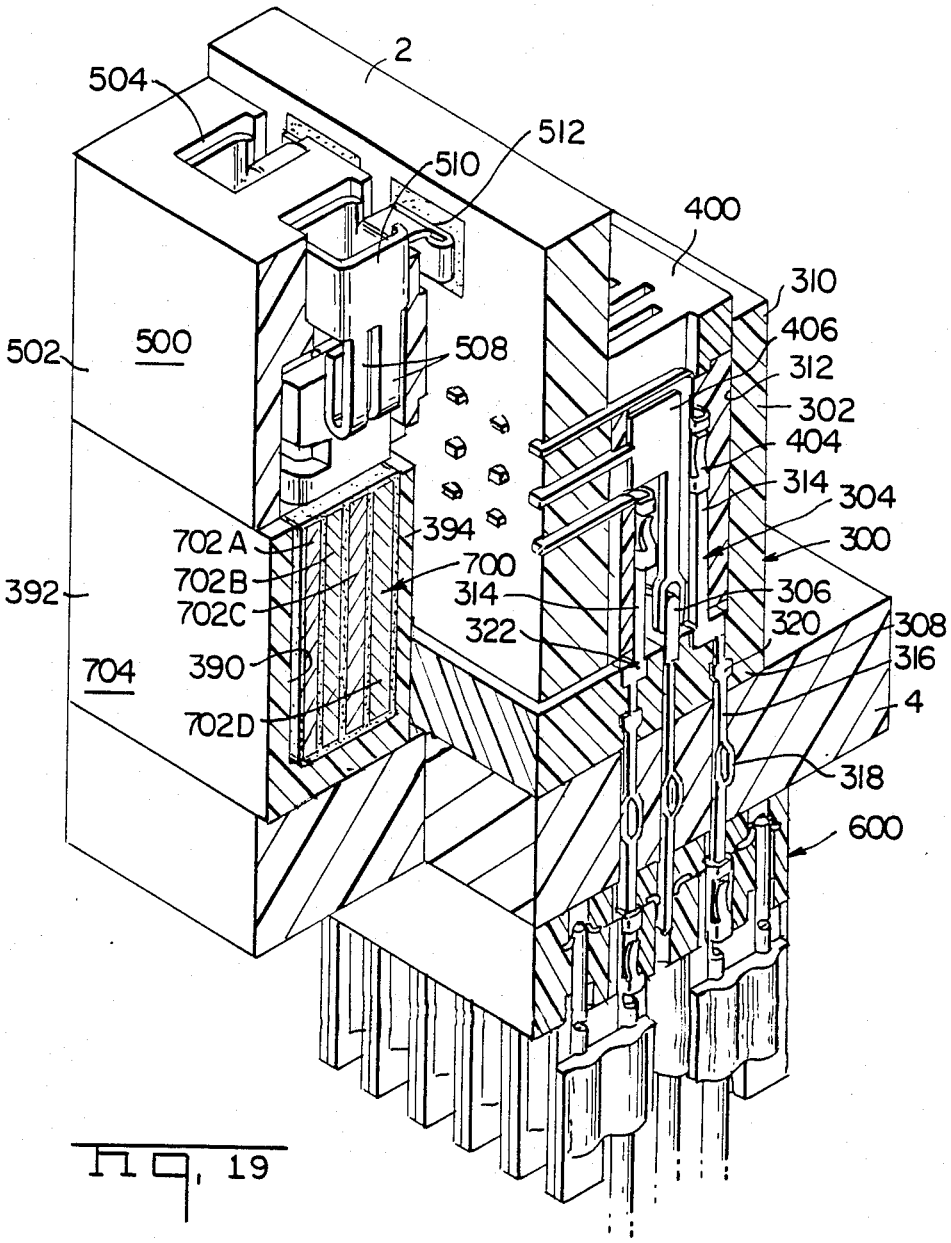
FIGS. 19 and 20 show an embodiment employing a laminated power bus having integral electric contact tabs.
Figure 20:
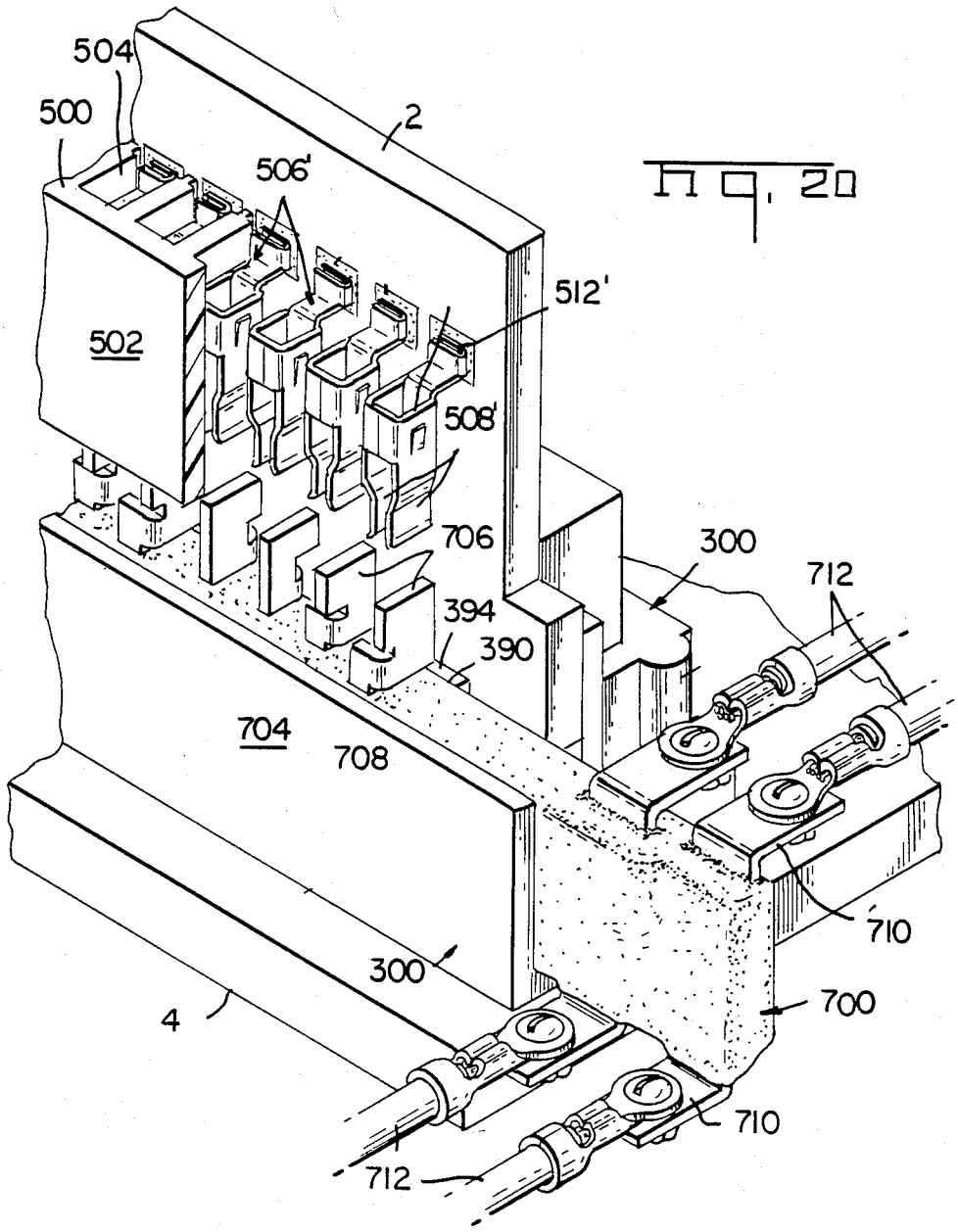

An embodiment, similar to the third embodiment and shown in FIGS. 19 and 20, employs a laminated power bus. The laminated power bus 700 comprises a series of individual busses 702A–D contained within an insulative housing 704. Busses 702 each are fabricated from a conductive metal, such as a conventional copper alloy, which is electrically conductive. In the preferred embodiment of this invention, there are four busses, two delivering power at different voltages, while the other two are maintained at a ground potential. The four busses 702A–D are parallel and are all partially encapsulated within an insulating material of conventional formulation. This insulating material pots the portions of the busses which are partially encapsulated. Each of the busses 702 has a plurality of upwardly extending contact tabs 706 which is bent at right angles to the busses 702. In the fourth embodiment of the invention, the width of the tabs 706 is substantially equal to the width of the laminated power bus 700. The height of ground tabs can be greater than the height of power tabs so that the ground tabs make first and break last. Each tab 706 extends across the other three busses such that the tabs 706 are located in a side-by-side configuration, with interconnecting portions 708 between each tab 706 and the respective bus 702 being staggered along the length of the ground bus 700. A notch separates a portion of each tab from the interconnection portion. Each tab 706 will then be in position to mate with contacts 508 or 508' of a female daughterboard power contact. The tabs 706 will also be oriented at right angles to the daughterboard.

Each power bus 702 includes an integral leg 710 which comprises a means of attaching the respective bus 702 to an external conductor 702. In one embodiment depicted herein, the external conductors 712 comprise wires which are external to the motherboard. Thus, power traces need not be incorporated into the motherboard. In this embodiment, the legs 710 have holes which permit the use of a screw down termination between the wires and the respective busses 702. It should be understood that other conventional external conductors and other conventional termination means could be easily employed.

The power section of the housing of this embodiment of the motherboard backplane connector 300' comprises an integral portion thereof. A continuous channel 390 extends along the entire length of the motherboard backplane connector 300'. This channel is formed by an outer wall 392 which comprises a portion of the housing of connector 300' and by a parallel inner wall 394 located adjacent the lower edge of the daughterboard. The laminated bus bar 700 is positioned within channel 390 between the wall 392 and the wall 394.

We claim:

1. A multi-contact electrical connector assembly for interconnecting corresponding traces on a motherboard and a daughterboard, comprising:

a motherboard signal connector including a plurality of motherboard signal terminals positioned within a motherboard signal housing;

a daughterboard signal connector including a plurality of daughterboard signal terminals positioned within a daughterboard signal housing;

a plurality of motherboard power terminals located on the motherboard and a plurality of daughterboard power terminals located on the daughterboard, the daughterboard power terminals being located adjacent one edge of the daughterboard on the opposite side from the daughterboard signal terminals, the motherboard and daughterboard power terminals comprising mating elements formed to engage each other and lie in planes oriented perpendicular to the daughterboard when the motherboard and daughterboard are mated in the multi-contact electrical connector assembly; and alignment means on the motherboard signal housing and the daughterboard signal housing for precisely aligning the motherboard signal terminals with the daughterboard signal terminals during mating, the motherboard and daughterboard signal terminals being matable without precise alignment in the direction normal to the daughterboard whereby daughterboards of different thicknesses can be employed.

2. The connector assembly of claim 1 wherein the daughterboard power terminals are positioned within a daughterboard power housing to comprise a daughterboard power connector located on the opposite side of the daughterboard from the daughterboard signal housing.

3. The connector assembly of claim 2 wherein the daughterboard signal and power connectors are positioned along one edge of the daughterboard.

4. The connector assembly of claim 3 wherein the motherboard power terminals are positioned in a motherboard power housing.

5. The connector assembly of claim 4 wherein the motherboard signal housing and the motherboard power housing together comprise a single housing having separate arrays of cavities for receiving motherboard signal and power terminals.

6. The connector assembly of claim 1 wherein the motherboard power terminals each have a planar tab contact portion oriented perpendicular to the daughterboard when mated.

7. The connector assembly of claim 6 wherein each motherboard power terminal has a plurality of through hole legs extending from the same planar tab contact portion to interconnect the motherboard power terminal to power traces in the motherboard.

8. The connector assembly of claim 6 wherein the planar tab portions of the motherboard power terminals each comprise tabs extending from a power bus having means for attachment to the surface of the motherboard to deliver power external to the motherboard.

9. The connector assembly of claim 6 wherein the daughterboard power terminals each include resilient springs matable with the planar tab contact portion of the motherboard power terminals, the resilient springs being oriented perpendicular to the daughterboard.

10. The connector assembly of claim 9 wherein the resilient springs comprise reversely formed members matable with opposite sides of the motherboard power terminals.

11. The connector assembly of claim 10 wherein the daughterboard power terminals are positioned within a daughterboard power housing, each daughterboard power terminal being positioned within a separate power terminal cavity in an upper wall of the daughterboard power housing.

12. The connector assembly of claim 11 wherein each daughterboard power terminal includes a surface mount leg.

13. The connector assembly of claim 12 wherein the surface mount leg extends through a recess in a sidewall of the daughterboard power housing.

14. The connector assembly of claim 1 wherein each daughterboard power terminal includes a surface mount leg.

15. A multi-contact electrical connector assembly for interconnecting corresponding traces on a motherboard and a daughterboard, comprising:

a motherboard connector including a plurality of terminals positioned within a motherboard housing;

daughterboard connector means including a plurality of terminals intermatable with corresponding terminals in the motherboard connector, and separate first and second daughterboard housings located on opposite sides on one edge of the daughterboard;

the terminals in the motherboard and daughterboard connectors being divided into a first terminal array and a second terminal array, the first terminal array in the first daughterboard housing being on an opposite side of the daughterboard from the second terminal array in the second daughterboard housing; and alignment means on the motherboard housing and the second daughterboard housing for precisely aligning only the second terminal arrays, the terminals in the first terminal array in the motherboard connector and first daughterboard housing being matable without precise alignment in the direction normal to the daughterboard whereby daughterboards of different thicknesses may be employed.

16. The connector assembly of claim 15 wherein the daughterboard housings together are relatively more rigid than the daughterboard and comprise means for maintaining the planarity of the daughterboard.

17. The connector assembly of claim 15 wherein the terminals in the first terminal array in the motherboard connector and the daughterboard connector comprise mating planar elements oriented perpendicular to the daughterboard.

* * * * *